US007059227B2

(12) United States Patent
Mori et al.

(10) Patent No.: US 7,059,227 B2
(45) Date of Patent: Jun. 13, 2006

(54) PAPER ABUTTED RULER

(75) Inventors: Makoto Mori, Katsushika-ku (JP); Fumio Shimizu, Katsushika-ku (JP)

(73) Assignee: Carl Manufacturing Co., Ltd., Tokyo (JP)

( * ) Notice: Subject to any disclaimer, the term of this patent is extended or adjusted under 35 U.S.C. 154(b) by 281 days.

(21) Appl. No.: 10/617,745

(22) Filed: Jul. 14, 2003

(65) Prior Publication Data

US 2004/0125058 A1 Jul. 1, 2004

(30) Foreign Application Priority Data

Jul. 18, 2002 (JP) ..... 2002-209794

(51) Int. Cl.
*B26D 7/01* (2006.01)

(52) U.S. Cl. ..... 83/451; 83/452; 83/468.7; 33/DIG. 1; 33/32.7; 33/42

(58) Field of Classification Search ..... 83/468.7, 83/451–468.94, 522.17; 335/285, 286, 287; 33/DIG. 1, 18.1, 18.2, 484, 32.4, 32.7, 42
See application file for complete search history.

(56) References Cited

U.S. PATENT DOCUMENTS

| | | | | |
|---|---|---|---|---|
| 2,790,498 A | | 4/1957 | Carscallen | |
| 3,014,751 A | | 12/1961 | Smith | |
| 3,082,799 A | * | 3/1963 | Kennedy | 83/438 |
| 3,779,119 A | | 12/1973 | Broides | |
| 3,792,636 A | | 2/1974 | Pottern | |
| 4,131,224 A | * | 12/1978 | Gerber et al. | 226/8 |
| 4,224,853 A | * | 9/1980 | Ruotsalainen | 83/412 |
| 5,146,823 A | | 9/1992 | Holmes | |
| 5,887,505 A | | 3/1999 | Mathian | |
| 5,964,041 A | | 10/1999 | Daniel | |
| 6,138,546 A | | 10/2000 | Hursey | |
| 6,786,123 B1 | * | 9/2004 | Chen | 83/485 |

FOREIGN PATENT DOCUMENTS

| | | |
|---|---|---|
| EP | 0 953 414 A2 | 11/1999 |
| JP | U 2-27890 | 2/1990 |
| JP | B2 2867062 | 12/1998 |
| JP | A 11-235692 | 8/1999 |
| JP | A 11-333788 | 12/1999 |

* cited by examiner

*Primary Examiner*—Allan N. Shoap
*Assistant Examiner*—Omar Flores Sánchez
(74) *Attorney, Agent, or Firm*—Oliff & Berridge, PLC

(57) ABSTRACT

A paper abutted ruler is provided which can easily be moved on the surface of a surface plate and can simply and accurately be positioned in place. The paper abutted ruler is constructed such that magnet bases rotatably supported at their one ends to a bottom portion of a ruler body and having magnets affixed to lower surfaces of the magnet bases are disposed in the ruler body at opposite-side positions spaced in the ruler longitudinal direction, and the magnet bases are rotated in a direction to tilt upward in interlock with depression of an attraction release button disposed nearly at the center of the ruler body. By depressing the attraction release button to rotate the magnet bases in the direction to tilt upward, the magnet bases are held in a state forming a predetermined angle relative to the surface of the surface plate.

15 Claims, 10 Drawing Sheets

PAPER ABUTTED RULER

BACKGROUND OF THE INVENTION

1. Field of the Invention

The present invention relates to a paper abutted ruler, and more particularly to a paper abutted ruler fixed to a surface plate of a cutter with attraction of a magnet to the surface plate.

2. Description of the Related Art

Conventionally, a paper abutted ruler is known which is detachably fixed to a surface plate of a cutter with attraction of a magnet to the surface plate and against which a reference side of paper is abutted to properly position the paper in a direction perpendicular to a cut line. As an example of such a paper abutted ruler, there is a ruler having a ruler body in the form of a rectangular parallelepiped that includes an upright surface, and also having a bonding magnet in the form of a friction sheet affixed to a bottom surface of the ruler body. The paper abutted ruler is placed on the surface of the steel-made surface plate of the cutter such that the upright surface is positioned at a proper distance from the cut line. Then, the paper abutted ruler is fixed to the surface plate with the magnet attracted to the surface plate. According to the known paper abutted ruler, however, it is very difficult to finely move the paper abutted ruler for position adjustment because the magnet always develops a maximum attraction force in a state in which the ruler is placed on the surface of the surface plate of the cutter, i.e., in a state in which the magnet is attracted to the surface plate. To avoid such a difficulty, a paper abutted ruler is proposed which employs a magnet having a weakened magnetic force. However, this type of paper abutted ruler accompanies a risk that the paper abutted ruler may shift with an impact caused upon the paper being abutted against the upright surface, and the paper may be cut in mismatch between the desired cut line and the actual cut line.

SUMMARY OF THE INVENTION

In view of the state of the art mentioned above, it is an object of the present invention to provide a paper abutted ruler, which can easily be positioned in place on the surface of a surface plate and can firmly be fixed to the surface plate.

To achieve the above object, the present invention provides a paper abutted ruler detachably fixed to a surface plate of a cutter with attraction of a magnet to position paper, which is abutted against an upright surface of the ruler, in a direction perpendicular to a cut line, wherein the ruler includes an attraction button and an attraction release button both disposed in an upper side, and a friction sheet attached to a bottom surface thereof for preventing a lateral shift, wherein the magnet is attracted to the surface plate through the friction sheet when the attraction button is depressed, and wherein the attraction of the magnet to the surface plate is released when the attraction release button is depressed.

In one preferable form of the present invention, the paper abutted ruler comprises a ruler body formed substantially into a rectangular parallelepiped and having an inner space; magnet bases disposed in the inner space of the ruler body at opposite-side positions spaced in the ruler longitudinal direction, the magnet bases being rotatably supported at one ends to the ruler body and having magnets affixed to lower surfaces of the magnet bases; cutouts formed in a bottom portion of the ruler body, the magnets being disposed in the cutouts to face the friction sheet; a magnet base rotating unit for rotating the magnet bases in a direction to tilt upward; a magnet base holding unit for holding the magnet base rotating unit in a state in which the magnet bases form a predetermined angle relative to the surface of the surface plate; and an attracting unit for releasing the magnet base rotating unit from the state held by the magnet base holding unit and tilting the magnet bases downward, thereby causing the magnets to be attracted to the surface plate.

In another preferable form of the present invention, the magnet base rotating unit comprises a pair of slide members disposed in the ruler body on one side of the attraction release button in the ruler widthwise direction and arranged on both sides of the attraction release button in the ruler longitudinal direction with one ends of the slide members oppositely facing each other, the slide member being slidable in the ruler longitudinal direction; a pair of first slopes formed in a lower portion of the attraction release button on both sides in the ruler longitudinal direction to provide a tapered shape; second slopes formed at one ends of the slide members and held in slide contact with the corresponding first slopes of the attraction release button; and third slopes formed at the other ends of the slide members and held in slide contact with corresponding lower corners of end faces of the magnet bases at the other end faces thereof.

In still another preferable form of the present invention, the magnet base holding unit comprises a rotating plate disposed on the other side of the attraction release button in the ruler widthwise direction in an opposed relation to the other side surface of the attraction release button, the rotating plate being rotatably supported at a lower end to the bottom portion of the ruler body; a rotating plate biasing unit for biasing the rotating plate toward the attraction release button; an engagement projection provided at a predetermined position of the attraction release button; and an engagement hole formed in the rotating plate and locking the engagement projection to releaseably hold the attraction release button in a depressed state.

In still another preferable form of the present invention, a fourth slope is formed in the one side surface of the attraction button in a lower portion thereof and held in contact with an inner corner of an upper end face of the rotating plate, and the attracting unit operates such that, when the attraction button is depressed, the fourth slope of the attraction button presses the inner corner of the upper end face of the rotating plate to rotate the rotating plate, thereby releasing the engagement projection of the attraction release button from the state locked by the engagement hole of the rotating plate.

In still another preferable form of the present invention, the ruler body is formed to have a raised bottom such that, when the ruler body is in a state of being placed on the surface plate, a gap substantially equal to a thickness of the friction sheet is formed between an outer surface of the bottom portion of the ruler body and the surface of the surface plate.

Thus, according to the present invention, by depressing the attraction button, the magnet can be attracted to the surface plate of the cutter and hence the paper abutted ruler can be fixed to the surface plate. Also, by depressing the attraction release button, the attraction of the magnet to the surface plate can be released and hence the paper abutted ruler can be moved on the surface of the surface plate in the horizontal direction. Further, since the friction sheet for preventing a lateral shift is attached to the bottom surface of the ruler, the surface of the surface plate is protected and prevented from being damaged. In addition, the paper abutted ruler having sufficient resistibility against a lateral shift can be obtained even with the magnet having a relatively small attraction force (magnetic force), and the paper abutted ruler can be prevented from shifting with an impact caused when the paper is abutted against the paper abutted ruler attracted to the surface plate.

According to one preferable form of the present invention, the magnet bases are rotated in the direction to tilt upward by the magnet base rotating unit, and the magnet base rotating unit is held by the magnet base holding unit in the state in which the magnet bases form the predetermined angle relative to the surface of the surface plate. In that state, the attraction forces (magnetic forces) of the magnets acting between the magnets and the surface plate become sufficiently small so that the paper abutted ruler can easily be moved on the surface of the surface plate and can easily be positioned in place. Further, since the attracting unit releases the magnet base rotating unit from the state held by the magnet base holding unit and tilts the magnet bases downward, the paper abutted ruler can be fixed to the surface plate while the magnets are attracted to the surface plate and the paper abutted ruler is positioned in place.

According to another preferable form of the present invention, when the attraction release button is depressed to move downward, the first slopes of the attraction release button press the corresponding second slopes of the slide members, whereupon the pair of slide members are moved in directions away from each other while sliding in contact with the corresponding first slopes of the attraction release button. At the same time, the third slopes of the slide members push up the corresponding lower corners of the magnet bases at the other end faces thereof, thus causing the magnet bases to rotate in the direction to tilt upward.

According to still another preferable form of the present invention, the attraction release button can be held in the depressed state with the engagement hole of the rotating plate locking the engagement projection of the attraction release button. Therefore, the magnet bases can be held in the state forming the predetermined angle relative to the surface of the surface plate.

According to still another preferable form of the present invention, when the attraction button is depressed to move downward in the state in which the magnet base holding unit holds the magnet bases in the rotated state, the fourth slope formed in the attraction button presses the inner corner of the upper end face of the rotating plate. Therefore, the rotating plate is rotated such that the upper end of the rotating plate is turned in a direction away from the attraction release button. As a result, the engagement projection of the attraction release button is released from the state locked by the engagement hole of the rotating plate, whereupon the magnet bases are rotated in the direction to tilt downward by the attraction forces (magnetic forces) acting between the magnets and the surface plate. Hence, the lower corners of the other end faces of the magnet bases press the corresponding third slopes of the pair of slide members, and the pair of slide members are moved so as to approach each other. At the same time, the second slopes of the pair of slide members press the corresponding first slopes of the attraction release button, whereby the attraction release button is pushed upward.

According to still another preferable form of the present invention, when positioning the paper abutted ruler on the surface of the surface plate, the paper abutted ruler can easily be moved on the surface of the surface plate and can be positioned in place. Also, when the paper abutted ruler is fixed to the surface plate, the magnets are attracted to the surface plate through the friction sheet. Therefore, the paper abutted ruler having sufficient resistibility against a lateral shift can be obtained even with the magnets having relatively small attraction forces (magnetic forces). In addition, the paper abutted ruler can be prevented from shifting with an impact caused when the paper is abutted against the paper abutted ruler attracted to the surface plate.

DESCRIPTION OF THE PREFERRED EMBODIMENTS

Figure 1:
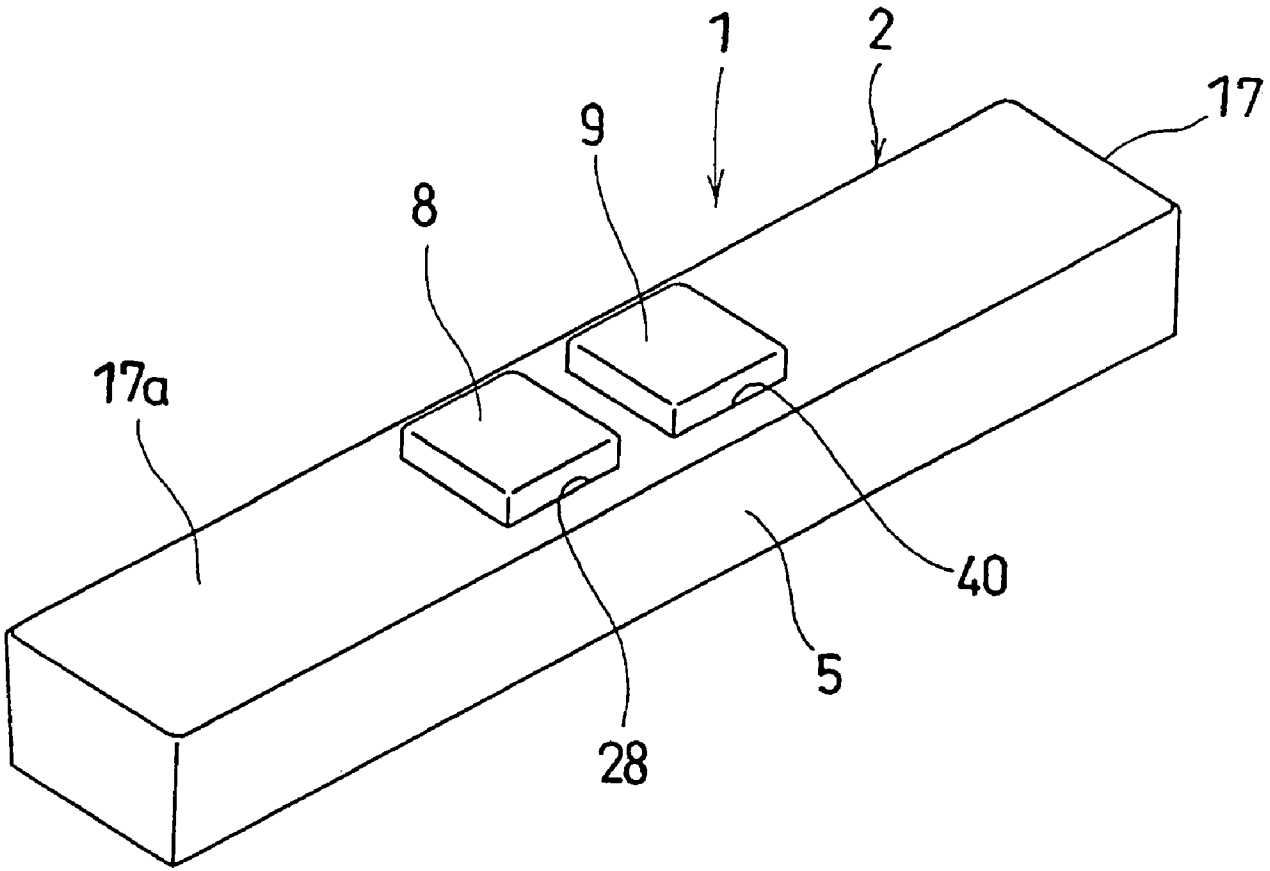
FIG. 1 is a perspective view of a paper abutted ruler of the present invention.
Figure 2:
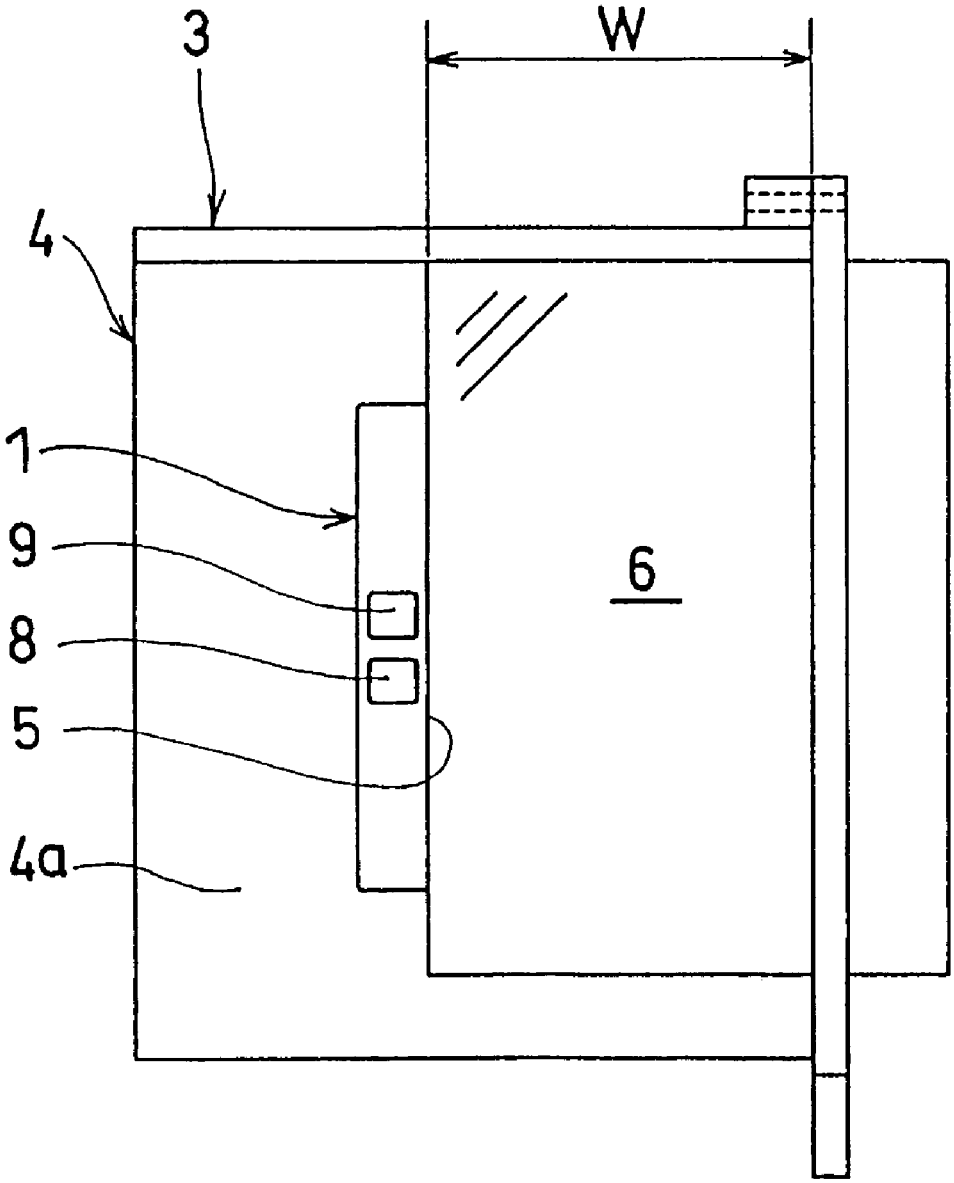
FIG. 2 shows a state in which paper is positioned by being abutted against the paper abutted ruler fixed to a surface plate of a cutter.

One embodiment of the present invention will be described below with reference to FIGS. 1 to 13. A paper abutted ruler 1 of the present invention, shown in FIGS. 1 and 2, has a ruler body 2 substantially in the form of a rectangular parallelepiped. The paper abutted ruler 1 is detachably fixed to a steel-made surface plate 4 of a cutter 3 by magnetic forces of magnets 7 (see FIGS. 3 to 8) disposed in the ruler body 2 while the ruler is positioned in place on a surface 4*a* of the surface plate 4. Then, paper 6 is abutted against an upright surface 5 of the ruler body 2 so that the paper 6 is properly positioned in a direction perpendicular to a cut line (i.e., the left-and-right direction as viewed on the drawing sheet of FIG. 2). A cut width (indicated by W in FIG. 2) of the paper 6 is thus adjusted. Also, the paper abutted ruler 1 of the present invention can easily be moved on the surface 4*a* of the surface plate 4 and positioned in place by operating an attraction release button 8 to reduce attraction forces (magnetic forces) of the magnets 7, which act between the magnets 7 and the surface plate 4. After the positioning, the paper abutted ruler 1 can be fixed to the surface plate 4 by operating an attraction button 9, thus causing the magnets 7 to be attracted to the surface plate 4 with a friction sheet 10 interposed between them.

Figure 3:
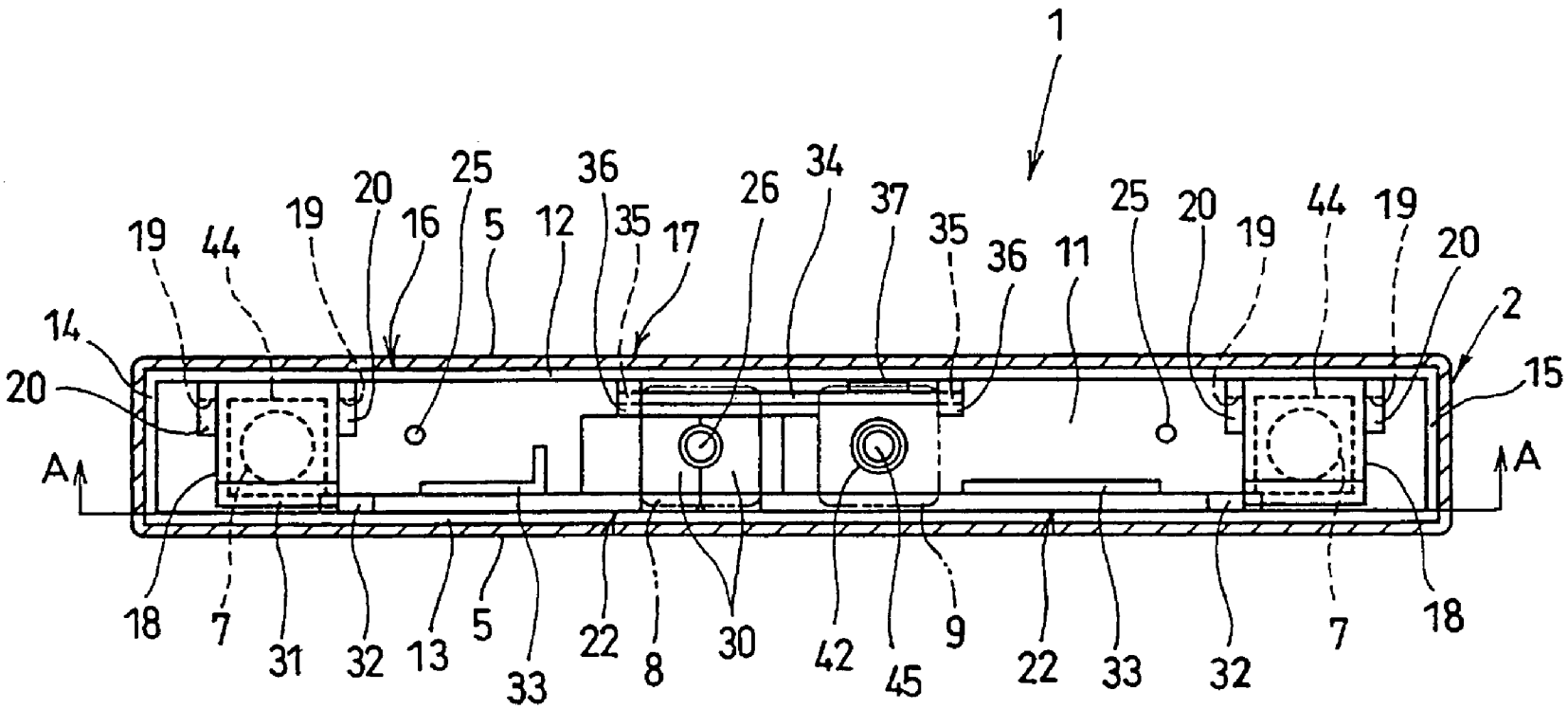
FIG. 3 is an explanatory view of the paper abutted ruler of the present invention, more specifically an opened-up plan view seeing through an upper body of the paper abutted ruler, the view showing a state in which a magnet is attracted to the surface plate.
Figure 4:
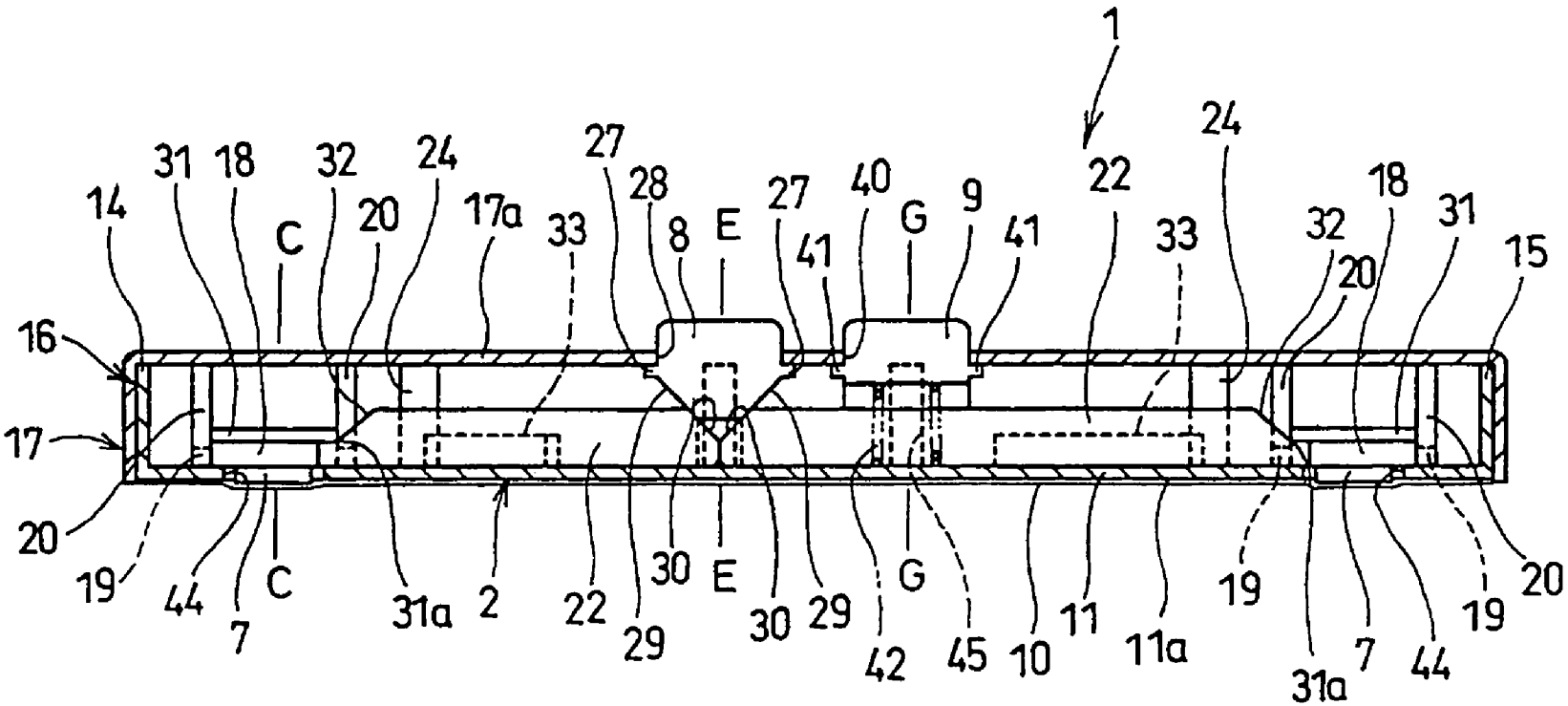
FIG. 4 is a sectional view taken along the arrowed line A—A in FIG. 3.
Figure 5:
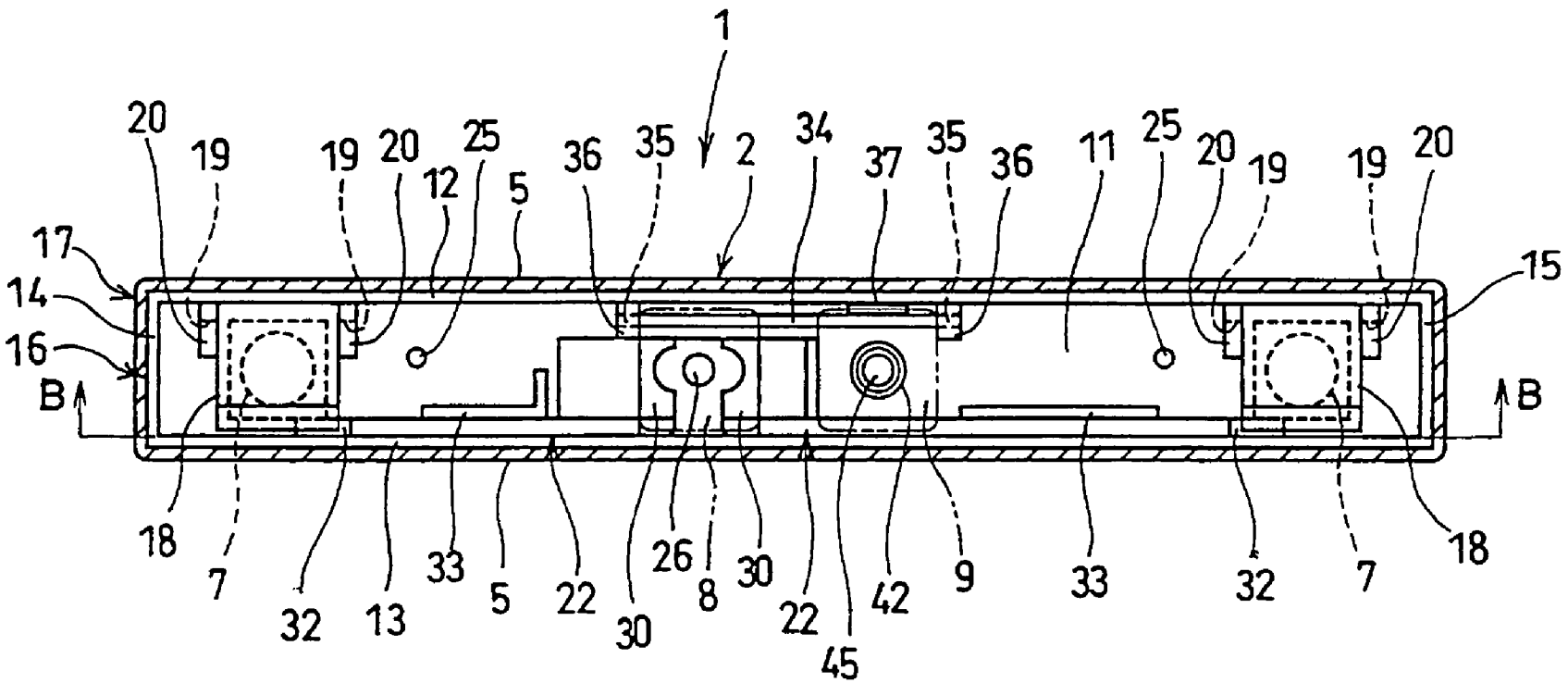
FIG. 5 is an explanatory view of the paper abutted ruler of the present invention, more specifically an opened-up plan view seeing through the upper body of the paper abutted ruler, the view showing a state in which a magnet base is held at a predetermined angle relative to the surface of the surface plate.
Figure 6:
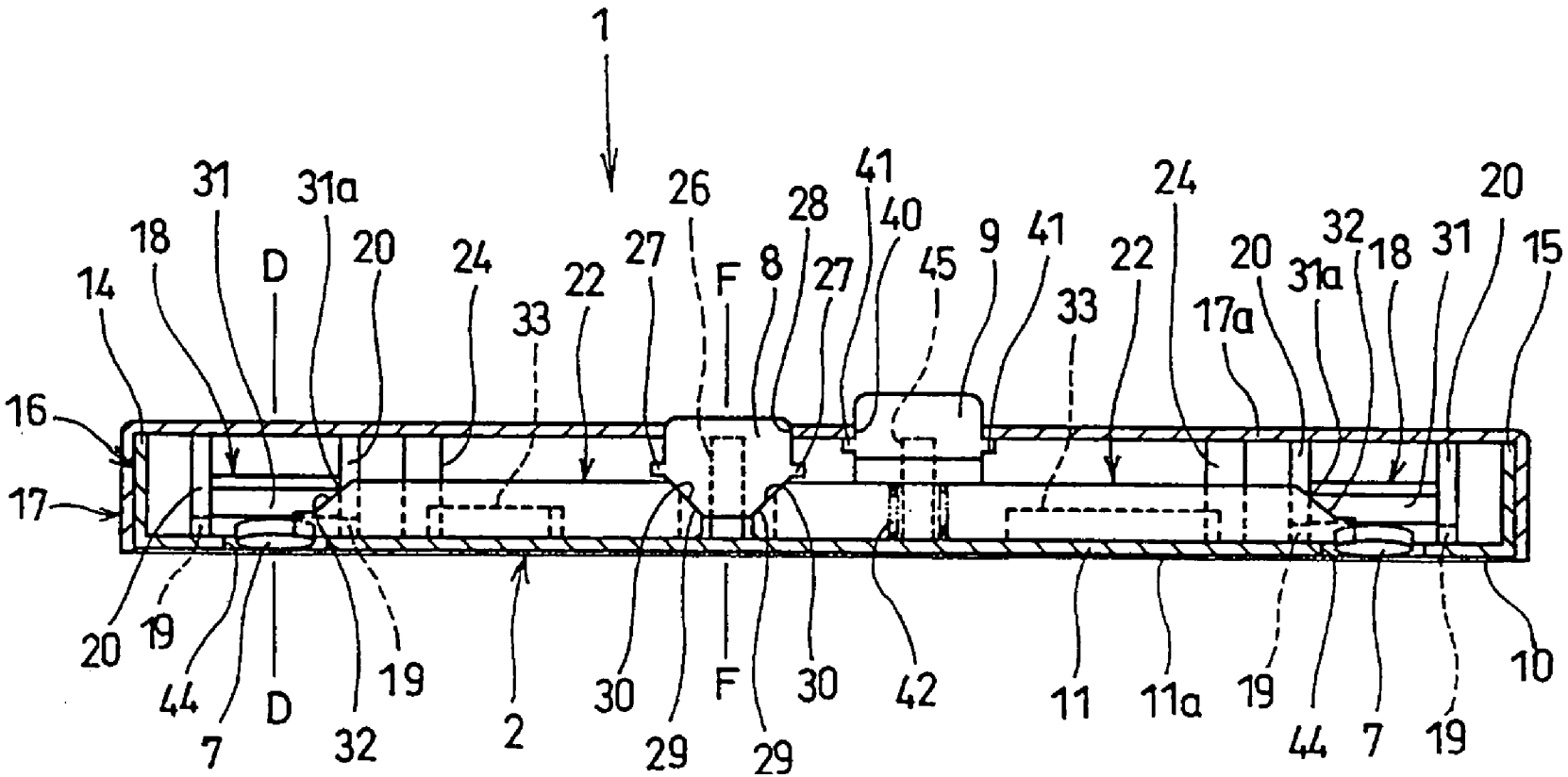
FIG. 6 is a sectional view taken along the arrowed line B—B in FIG. 5.

As shown in FIGS. 3 to 6, the ruler body 2 is divided into a lower body 16 constructed by arranging four side walls 12 to 15 around a rectangular bottom portion 11 so as to erect at a right angle from the bottom portion 11, and an upper body 17 being in the form of a cap fitting to the lower body 16 and having an upright surface 5 against which the paper 6 is abutted. Bosses 24 provided with internal threads tapped in their end faces are perpendicularly extended from a backside of a base portion 17*a* of the upper body 17 at predetermined intervals in the ruler longitudinal direction. Also, screw insertion holes 25 are formed in the bottom portion 11 of the lower body 16 at positions matched with the internal threads of the bosses 24. By inserting screws (not shown) through the screw insertion holes 25 and screwing them into the internal threads of the bosses 24, the bottom portion 11 of the lower body 16 and the end faces of the bosses 24 of the upper body 17 are tightly contacted with each other. The ruler body 2 thus assembled has a structure that, when the ruler body 2 is placed on the surface 4*a* of the surface plate 4, a gap substantially equal to a thickness T1 (see FIG. 7) of the friction sheet 10 is formed between a outer surface 11*a* of the bottom portion 11 and the plate surface 4*a*, as shown in FIGS. 4 and 6. The friction sheet 10 is attached to the bottom-portion outer surface 11*a* of the lower body 16. Further, as shown in FIGS. 3 to 8, nearly square cutouts 44 are formed in the bottom portion 11 of the lower body 16 at positions facing the magnets 7. Additionally, as shown in sum of the thickness T1 of the friction sheet 10 and a thickness T3 of the bottm portion 11 of the lower body 16 (T2=T1+T3).

Figure 7:
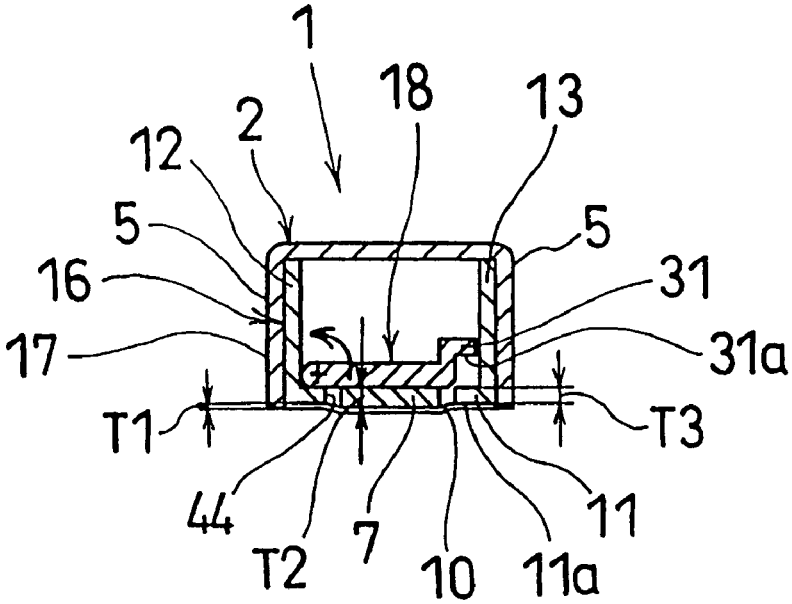
FIG. 7 is a sectional view taken along the line C—C in FIG. 4.
Figure 8:
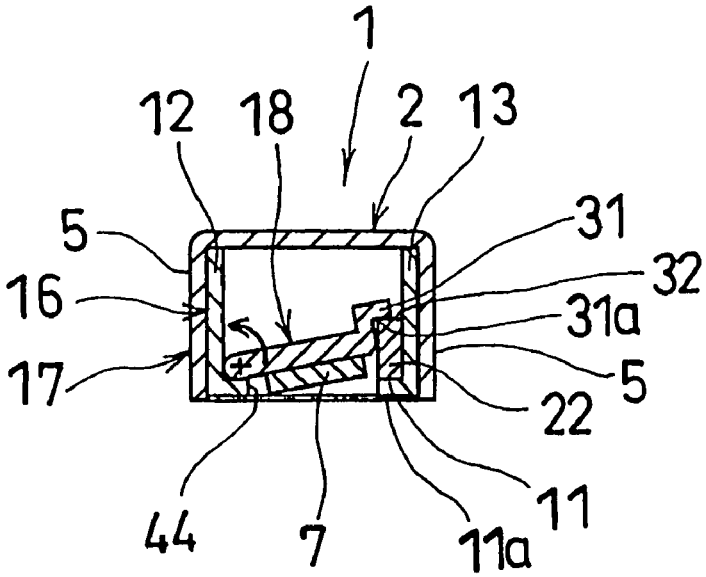
FIG. 8 is a sectional view taken along the line D—D in FIG. 6.
Figure 9:
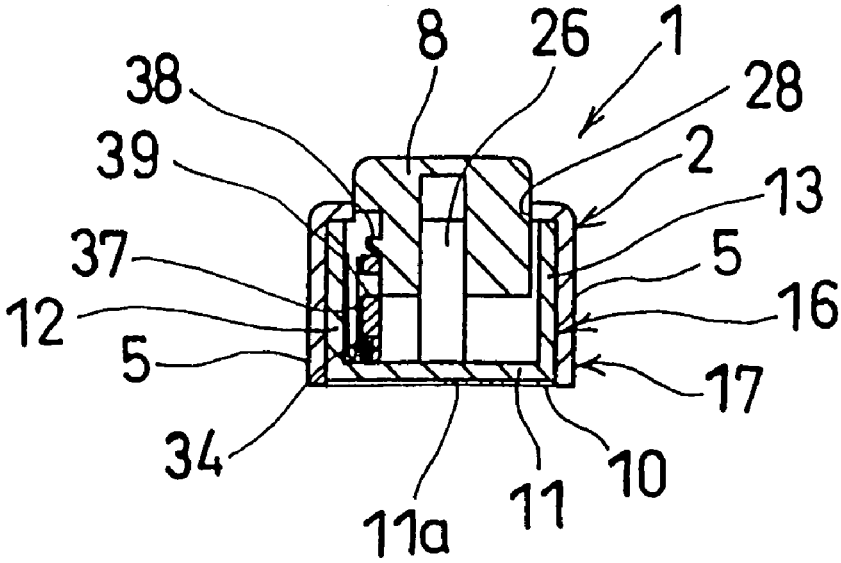
FIG. 9 is a sectional view taken along the line E—E in FIG. 4.
Figure 10:
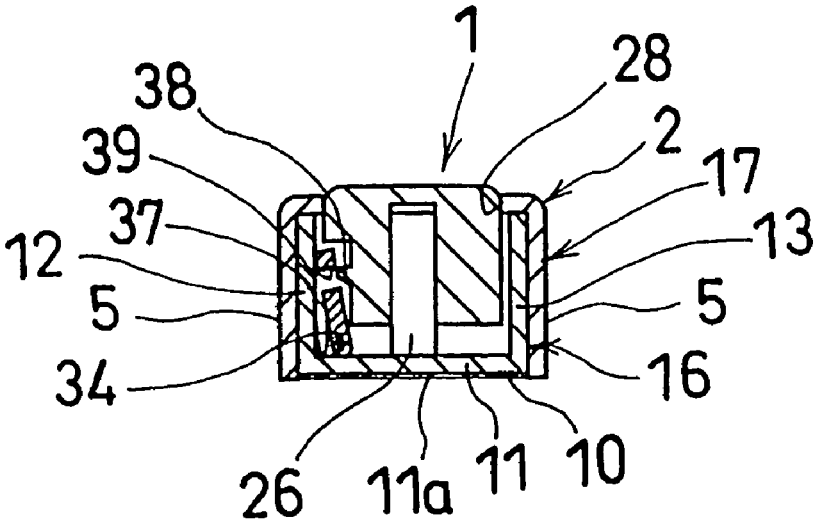
FIG. 10 is an explanatory view of the paper abutted ruler of the present invention, more specifically a sectional view showing a state immediately after a rotating plate is rotated from the state of FIG. 9 with depression of an attraction button and an engagement projection of an attraction release button is released from a state locked by an engagement hole of the rotating plate.

Magnet bases 18 are disposed in the lower body 16 at opposite-side positions spaced in the ruler longitudinal direction (i.e., the left-and-right direction as viewed on the drawing sheets of FIGS. 3 to 6). As shown in FIGS. 3 and 5, the magnet 7 in a disk-like form is fixed to a lower surface of each magnet base 18. Projections 19 are formed at one end of the magnet base 18 on both sides thereof, and these projections 19 are rotatably supported by supports 20 disposed at a corner between the bottom portion 11 of the lower body 16 and the side wall 12. Further, as shown in FIGS. 7 and 8, each magnet base 18 has at the other end a stepped portion 31, which is elevated from the lower surface of the magnet base 18 and has a corner 31*a* held in slide contact with a third slope 32 of a slide member 22 described later.

Substantially at the center of the ruler body 2 in the ruler longitudinal direction, the attraction release button 8 is disposed and guided to be movable in a direction perpendicular to the bottom portion 11 by a shaft 26 erected on the bottom portion 11 of the lower body 16. As shown in FIG. 4, the attraction release button 8 has a top projecting from a cutout 28 formed in the base portion 17*a* of the upper body 17, and its upward movement is restricted with hooks 27 projected from both button ends in the ruler longitudinal direction striking against edges of the cutout 28. Also, the attraction release button 8 has first slopes 29 formed in its lower portion on both sides in the ruler longitudinal direction and providing a tapered shape. Further, as shown in FIGS. 3 to 6, slide members 22 are disposed on both sides of the attraction release button 8 in the ruler longitudinal direction. Each of the slide members 22 has a second slope 30 formed at one end and held in slide contact with the corresponding first slope 29 of the attraction release button 8, and also has a third slope 32 formed at the other end and held in slide contact with the corner 31*a* of the stepped portion 31 of the magnet base 18. The slide members 22 are supported by guide ribs 33 provided on the side wall 13 and on the bottom portion 11 of the lower body 16 such that each slide member is able to slide in the ruler longitudinal direction.

When the attraction release button 8 is depressed to move downward, the first slopes 29 of the attraction release button 8 press the corresponding second slopes 30 of the slide members 22. Therefore, the pair of slide members 22 are moved in opposite directions away from each other while the second slopes 30 slide in contact with the corresponding first slopes 29 of the attraction release button 8. At the same time, the third slope 32 of each slide member 22 pushes up the corner 31*a* of the stepped portion 31 of the magnet base 18 so that the magnet base 18 is rotated in a direction to tilt upward (i.e., counterclockwise in FIG. 7). Further, as shown in FIGS. 3, 5, and 9 to 11, a rotating plate 34 is disposed between the attraction release button 8 and the side wall 12 of the lower body 16. The rotating plate 34 has projections 35 formed at a lower end on both sides thereof, and these projections 35 are rotatably supported by supports 36 disposed on the bottom portion 11 of the lower body 16.

Figure 11:
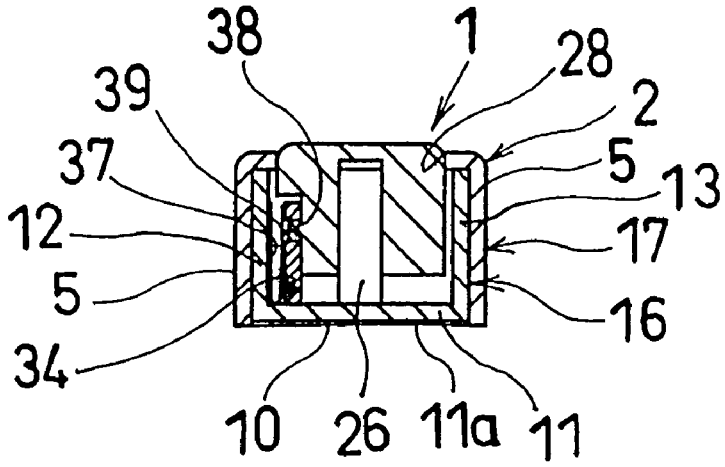
FIG. 11 is a sectional view taken along the line F—F in FIG. 6.

A spring member 37 made by folding double a steel plate so as to have a nearly V-shaped section is interposed between the rotating plate 34 and the side wall 12 of the lower body 16. The spring member 37 biases the rotating plate 34 toward the attraction release button 8. An engagement projection 38 is provided on a lateral surface of the attraction release button 8, which faces the side wall 12 of the lower body 16. Further, as shown in FIG. 11, an engagement hole 39 is formed in the rotating plate 34 to lock the engagement projection 38 when the attraction release button 8 is depressed. In the paper abutted ruler 1 of the present invention, the attraction release button 8 is held in a depressed state with the engagement hole 39 of the rotating plate 34 locking the engagement projection 38 of the attraction release button 8. Accordingly, as shown in FIG. 8, the magnet base 18 is held in a state forming a predetermined angle relative to the surface 4*a* of the surface plate 4.

Figure 12:
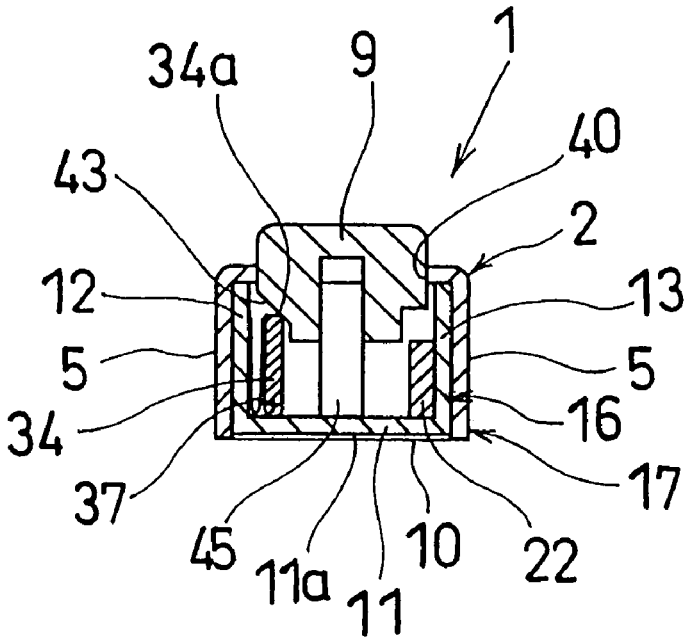
FIG. 12 is a sectional view taken along the line G—G in FIG. 4.
Figure 13:
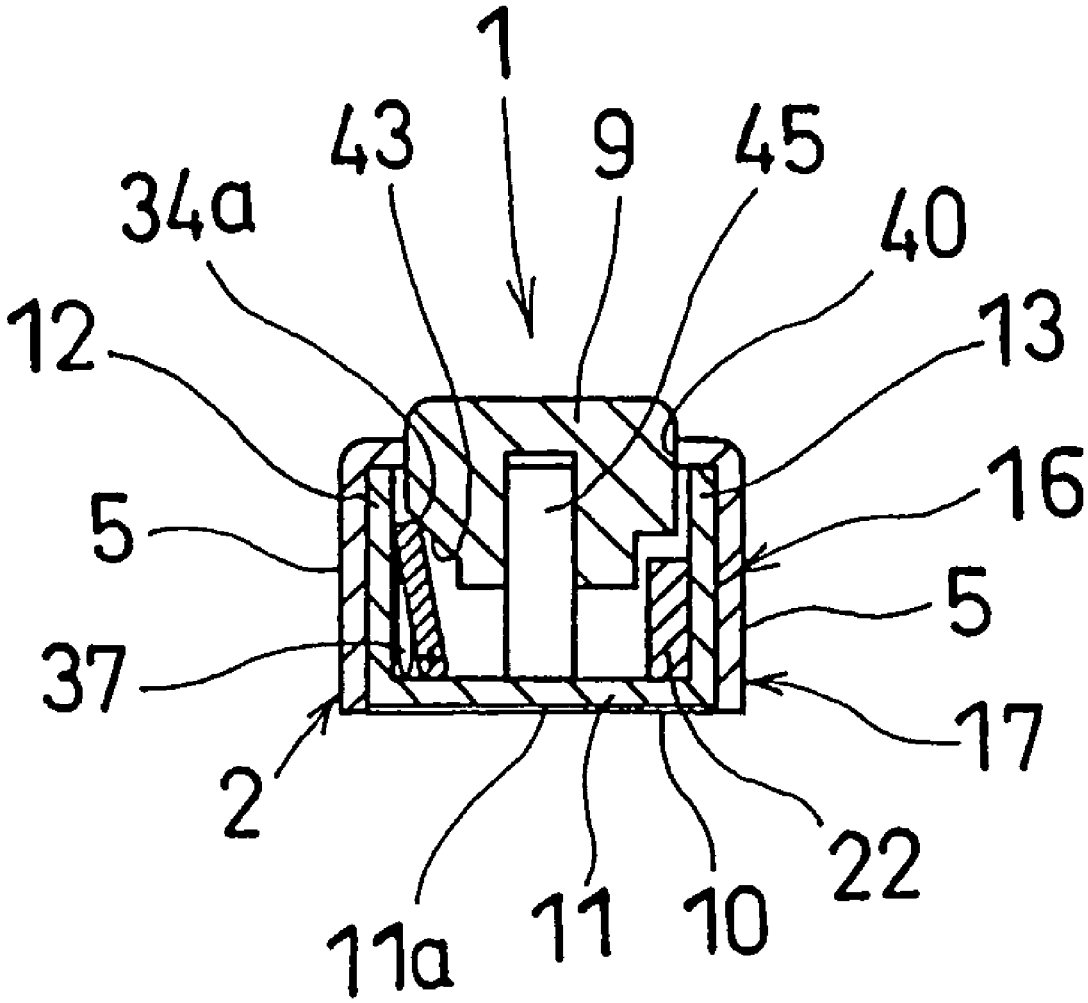
FIG. 13 shows a state in which the attraction button is depressed to rotate the rotating plate from the state shown in FIG. 12.

As shown in FIGS. 3 to 6, an attraction button 9 is disposed in the ruler body 2 adjacently to the attraction release button 8 and is biased upward by a compressed coil spring 42 while being guided in the direction perpendicular to the bottom portion 11 by a shaft 45 erected on the bottom portion 11 of the lower body 16. As shown in FIG. 4, the attraction button 9 has a top projecting from a cutout 40 formed in the base portion 17*a* of the upper body 17, and its upward movement is restricted with hooks 41 projected from both button ends in the ruler longitudinal direction striking against edges of the cutout 40. Also, as shown in FIGS. 12 and 13, the attraction button 9 has a fourth slope 43, which is formed at its lower position in a facing relation to the side wall 12 of the lower body 16 and is held in slide contact with a corner 34*a* of an upper end face of the rotating plate 34.

In the paper abutted ruler 1 of the present invention, when the attraction button 9 is depressed to move downward in the state in which the attraction release button 8 is depressed with the engagement hole 39 of the rotating plate 34 locking the engagement projection 38 of the attraction release button 8 (see FIG. 11), the fourth slope 43 formed in the attraction button 9 presses the corner 34*a* of the upper end face of the rotating plate 34. Therefore, the upper end of the rotating plate 34 is rotated in a direction away from the attraction release button 8, and hence the rotating plate 34 is rotated counterclockwise in FIGS. 9 to 13. As a result, the engagement projection 38 of the attraction release button 8 is released from the state locked by the engagement hole 39 of the rotating plate 34, whereupon the magnet bases 18 are rotated in the direction to tilt downward by the attraction forces (magnetic forces) acting between the magnets 7 and the surface plate 4. Further, the corners 31*a* of the stepped portions 31 of the magnet bases 18 press the corresponding third slopes 32 of the pair of slide members 22, and the pair of slide members 22 are moved so as to approach each other. At the same time, the second slopes 30 of the pair of slide members 22 press the corresponding first slopes 29 of the attraction release button 8, whereby the attraction release button 8 is naturally pushed upward.

Next, the operation of the paper abutted ruler 1 of the present invention will be described below. As shown in FIGS. 4 and 7, the paper abutted ruler 1 of the present invention is fixed to the surface plate 4 by causing the magnets 7 to be attracted to the surface plate 4 of the cutter 3 through the friction sheet 10. To slide the paper abutted ruler 1 on the surface 4*a* of the surface plate 4 to position it in another place from the above state in which the ruler is fixed to the surface plate 4, the attraction release button 8 is depressed to move downward as shown in FIG. 6. With this operation, the first slopes 29 of the attraction release button 8 press the corresponding second slopes 30 of the slide members 22. Therefore, the pair of slide members 22 are moved in opposite directions away from each other while the second slopes 30 slide in contact with the corresponding first slopes 29 of the attraction release button 8. With the movements of the pair of the slide members 22, the third slopes 32 of the slide members 22 push up the corresponding corners 31*a* of the stepped portions 31 of the magnet bases 18, whereby the magnet bases 18 are rotated in the direction to tilt upward (counterclockwise in FIG. 7), as shown in FIG. 8.

Subsequently, when the attraction release button 8 is depressed to a predetermined lower level, the engagement projection 38 of the attraction release button 8 is engaged in the engagement hole 39 of the rotating plate 34 and is locked by the engagement hole 39, as shown in FIG. 11, to prevent the attraction release button 8 from moving upward from that level. Thus, as shown in FIG. 8, the magnet bases 18 are held in the state forming the predetermined angle relative to the surface 4*a* of the surface plate 4. In this state, the attraction forces (magnetic forces) of the magnets 7 acting between the magnets 7 floating away from the friction sheet 10 and the surface plate 4 become sufficiently small. Because the friction sheet 10 is affixed only to the raised outer surface 11*a* of the bottom portion 11 of the lower body 16, the paper abutted ruler 1 can easily be moved in the horizontal direction and positioned in place on the surface 4*a* of the surface plate 4.

In order to fix the paper abutted ruler 1 to the surface plate 4 which has properly been positioned on the surface 4*a* of the surface plate 4, the attraction button 9 is depressed as shown in FIGS. 12 and 13. With this operation, the fourth slope 43 of the attraction button 9 presses the corner 34*a* of the rotating plate 34, thereby pushing the upper end of the rotating plate 34 and causing the rotating plate 34 to rotate in the direction away from the attraction release button 8. As a result, the engagement projection 38 of the attraction release button 8 is released from the state locked by the engagement hole 39 of the rotating plate 34, whereupon the magnet bases 18 are rotated in the direction to tilt downward by the attraction forces (magnetic forces) acting between the magnets 7 and the surface plate 4. Hence, the magnets 7 are attracted to the surface plate 4 through the friction sheet 10 and the paper abutted ruler 1 can be fixed to the surface plate 4. On the other hand, with the rotation of the magnet bases 18 in the direction to tilt downward, the corners 31*a* of the stepped portions 31 of the magnet bases 18 press the corresponding third slopes 32 of the slide members 22, and the pair of slide members 22 are moved so as to approach each other. As the pair of slide members 22 move in directions to approach each other, the second slopes 30 of the pair of slide members 22 press the corresponding first slopes 29 of the attraction release button 8, whereby the attraction release button 8 is pushed upward.

This embodiment has advantages given below.

The paper abutted ruler 1 is constructed such that the magnet bases 18 rotatably supported at their one ends to the bottom portion 11 of the ruler body 2 and having the magnets 7 affixed to the lower surfaces of the magnet bases are disposed in the ruler body 2 at opposite-side positions spaced in the ruler longitudinal direction, and the magnet bases 18 are rotated in the direction to tilt upward in interlock with the depression of the attraction release button 8 disposed nearly at the center of the ruler body 2. Further, the magnet bases 18 having rotated in the direction to tilt upward are releaseably held in the state forming the predetermined angle relative to the surface 4*a* of the surface plate 4. Thus, since the attraction release button 8 is depressed to rotate the magnet bases 18 in the direction to tilt upward and the magnet bases 18 are held in the state forming the predetermined angle relative to the surface 4*a* of the surface plate 4, the attraction forces (magnetic forces) of the magnets 7 acting between the magnets 7 and the surface plate 4 become sufficiently small so that the paper abutted ruler 1 can easily be moved on the surface 4*a* of the surface plate 4. It is hence possible to simply and accurately perform the positioning of the paper abutted ruler 1.

When the attraction button 9 is depressed, the magnet bases 18 are released from the state locked at the predetermined angle relative to the surface 4*a* of the surface plate 4. By releasing the magnet bases 18 from the locked state with the depression of the attraction button 9, therefore, the magnet bases 18 are rotated in the direction to tilt downward by both their own weight and the attraction forces (magnetic forces) acting between the magnets 7 and the surface plate 4 so that the magnets 7 are attracted to the surface plate 4 with the friction sheet 10 interposed between them. As a result, the paper abutted ruler 1 having sufficient resistibility against a lateral shift can be obtained even with the magnets 7 having relatively small attraction forces (magnetic forces). In addition, the paper abutted ruler 1 can be prevented from shifting with an impact caused when the paper 6 is abutted against the paper abutted ruler 1 attracted to the surface plate 4.

The bottom portion 11 of the ruler body 2 is formed to provide a raised bottom and the friction sheet 10 having the thickness substantially equal to the gap between the bottom portion 11 and the surface 4*a* of the surface plate 4 is attached to the outer surface 11*a* of the bottom portion 11. Therefore, when the ruler body 2 is moved on the surface 4*a* of the surface plate 4, the friction sheet 10 is avoided from being pressed against the surface 4*a* of the surface plate 4 and the paper abutted ruler 1 can smoothly be moved and positioned in place on the surface 4*a* of the surface plate 4.

Since the thickness T2 of each magnet 7 is set equal to the sum of the thickness T1 of the friction sheet 10 and the thickness T3 of the bottom portion 11, the paper abutted ruler 1 can firmly be fixed to the surface plate 4.

It is to be noted that the present invention is not limited to the embodiment described above, and the ruler construction may be modified, by way of example, as follows.

While, in the above embodiment, the magnet base is rotated about the shaft extending in the ruler longitudinal direction upon the depression of the attraction release button, the magnet base may be rotated about a shaft extending in the ruler widthwise direction.

As fully described above, the present invention is able to provide a paper abutted ruler which can easily be positioned in place on the surface of a surface plate and can firmly be fixed to the surface plate.

What is claimed is:

1. A paper abutted ruler detachably fixed to a surface plate of a cutter with attraction of a magnet to position paper, which is abutted against an upright surface of the ruler, in a direction perpendicular to a cut line, wherein the ruler includes an attraction button and an attraction release button both disposed in an upper side, a friction sheet attached to a bottom surface thereof for preventing a lateral shift, and a ruler body formed substantially into a rectangular parallelepiped and having an inner space; magnet bases disposed in the inner space of said ruler body at opposite-side positions spaced in the ruler longitudinal direction, said magnet bases being rotatably supported at one ends to said ruler body and having magnets affixed to lower surfaces of said magnet bases; cutouts formed in a bottom portion of said ruler body, said magnets being disposed in said cutouts to face said friction sheet; magnet base rotating means for rotating said magnet bases in a direction to tilt upward; magnet base holding means for holding said magnet base rotating means in a state in which said magnet bases form a predetermined angle relative to the surface of said surface plate; and attracting means for releasing said magnet base rotating means from the state held by said magnet base holding means and tilting said magnet bases downward, thereby causing said magnets to be attracted to said surface plate, and wherein said magnet is attracted to said surface plate through said friction sheet when said attraction button is depressed, and wherein the attraction of said magnet to said surface plate is released when said attraction release button is depressed.

2. A paper abutted ruler according to claim 1, wherein said ruler body is formed to have a raised bottom such that, when said ruler body is in a state of being placed on said surface plate, a gap substantially equal to a thickness of said friction sheet is formed between an outer surface of the bottom portion of said ruler body and the surface of said surface plate.

3. A paper abutted ruler according to claim 1, wherein said magnet base rotating means comprises a pair of slide members disposed in said ruler body on one side of said attraction release button in the ruler widthwise direction and arranged on both sides of said attraction release button in the ruler longitudinal direction with one ends of said slide members oppositely facing each other, said slide member being slidable in the ruler longitudinal direction; a pair of first slopes formed in a lower portion of said attraction release button on both sides in the ruler longitudinal direction to provide a tapered shape; second slopes formed at one ends of said slide members and held in slide contact with the corresponding first slopes of said attraction release button; and third slopes formed at the other ends of said slide members and held in slide contact with corresponding lower corners of said magnet bases at the other end faces thereof.

4. A paper abutted ruler according to claim 1, wherein said magnet base holding means comprises a rotating plate disposed on the other side of said attraction release button in the ruler widthwise direction in an opposed relation to the other side surface of said attraction release button, said rotating plate being rotatably supported at a lower end to the bottom portion of said ruler body; rotating plate biasing means for biasing said rotating plate toward said attraction release button; an engagement projection provided at a predetermined position of said attraction release button; and an engagement hole formed in said rotating plate and locking the engagement projection to releaseably hold said attraction release button in a depressed state.

5. A paper abutted ruler according to claim 1, wherein a fourth slope is formed in the one side surface of said attraction button in a lower portion thereof and held in contact with an inner corner of an upper end face of said rotating plate, and said attracting means operates such that, when said attraction button is depressed, the fourth slope of said attraction button presses the inner corner of the upper end face of said rotating plate to rotate said rotating plate, thereby releasing the engagement projection of said attraction release button from the state locked by engagement hole of said rotating plate.

6. A paper abutted ruler according to claim 1, wherein said ruler body is formed to have a raised bottom such that, when said ruler body is in a state of being placed on said surface plate, a gap substantially equal to a thickness of said friction sheet is formed between an outer surface of the bottom portion of said ruler body and the surface of said surface plate.

7. A paper abutted ruler according to claim 1, wherein a fourth slope is formed in the one side surface of said attraction button in a lower portion thereof and held in contact with an inner corner of an upper end face of said rotating plate, and said attracting means operates such that, when said attraction button is depressed, the fourth slope of said attraction button presses the inner corner of the upper end face of said rotating plate to rotate said rotating plate, thereby releasing the engagement projection of said attraction release button from the state locked by the engagement hole of said rotating plate.

8. A paper abutted ruler according to claim 7, wherein said ruler body is formed to have a raised bottom such that, when said ruler body is in a state of being placed on said surface plate, a gap substantially equal to a thickness of said friction sheet is formed between an outer surface of the bottom portion of said ruler body and the surface of said surface plate.

9. A paper abutted ruler according to claim 1, wherein said magnet base rotating means comprises a pair of slide members disposed in said ruler body on one side of said attraction release button in the ruler widthwise direction and arranged on both sides of said attraction release button in the ruler longitudinal direction with one ends of said slide members oppositely facing each other, said slide member being slidable in the ruler longitudinal direction; a pair of first slopes formed in a lower portion of said attraction release button on both sides in the ruler longitudinal direction to provide a tapered shape; second slopes formed at one ends of said slide members and held in slide contact with the corresponding first slopes of said attraction release button; and third slopes formed at the other ends of said slide members and held in slide contact with corresponding lower corners of said magnet bases at the other end faces thereof.

10. A paper abutted ruler according to claim 9, wherein said magnet base holding means comprises a rotating plate disposed on the other side of said attraction release button in the ruler widthwise direction in an opposed relation to the other side surface of said attraction release button, said rotating plate being rotatably supported at a lower end to the bottom portion of said ruler body; rotating plate biasing means for biasing said rotating plate toward said attraction release button; an engagement projection provided at a predetermined position of said attraction release button; and an engagement hole formed in said rotating plate and locking the engagement projection to releaseably hold said attraction release button in a depressed state.

11. A paper abutted ruler according to claim 9, wherein a fourth slope is formed in the one side surface of said attraction button in a lower portion thereof and held in contact with an inner corner of an upper end face of said rotating plate, and said attracting means operates such that, when said attraction button is depressed, the fourth slope of said attraction button presses the inner corner of the upper end face of said rotating plate to rotate said rotating plate, thereby releasing the engagement projection of said attraction release button from the state locked by the engagement hole of said rotating plate.

12. A paper abutted ruler according to claim 9, wherein said ruler body is formed to have a raised bottom such that, when said ruler body is in a state of being placed on said surface plate, a gap substantially equal to a thickness of said friction sheet is formed between an outer surface of the bottom portion of said ruler body and the surface of said surface plate.

13. A paper abutted ruler according to claim 1, wherein said magnet base holding means comprises a rotating plate disposed on the other side of said attraction release button in the ruler widthwise direction in an opposed relation to the other side surface of said attraction release button, said rotating plate being rotatably supported at a lower end to the bottom portion of said ruler body; rotating plate biasing means for biasing said rotating plate toward said attraction release button; an engagement projection provided at a predetermined position of said attraction release button; and an engagement hole formed in said rotating plate and locking the engagement projection to releaseably hold said attraction release button in a depressed state.

14. A paper abutted ruler according to claim 13, wherein a fourth slope is formed in the one side surface of said attraction button in a lower portion thereof and held in contact with an inner corner of an upper end face of said rotating plate, and said attracting means operates such that, when said attraction button is depressed, the fourth slope of said attraction button presses the inner corner of the upper end face of said rotating plate to rotate said rotating plate, thereby releasing the engagement projection of said attraction release button from the state locked by the engagement hole of said rotating plate.

15. A paper abutted ruler according to claim 13, wherein said ruler body is formed to have a raised bottom such that, when said ruler body is in a state of being placed on said surface plate, a gap substantially equal to a thickness of said friction sheet is formed between an outer surface of the bottom portion of said ruler body and the surface of said surface plate.

* * * * *